US006726053B1

(12) United States Patent
Harrold

(10) Patent No.: US 6,726,053 B1
(45) Date of Patent: Apr. 27, 2004

(54) CHILD RESISTANT MULTIPLE DOSAGE BLISTER PACK DISPENSER

(76) Inventor: John E. Harrold, 27 Milford Rd., Bloomsbury, NJ (US) 08804

( * ) Notice: Subject to any disclaimer, the term of this patent is extended or adjusted under 35 U.S.C. 154(b) by 45 days.

(21) Appl. No.: 10/282,428

(22) Filed: Oct. 29, 2002

(51) Int. Cl.[7] ..... G07F 11/66
(52) U.S. Cl. ..... 221/25; 206/531
(58) Field of Search ..... 221/25, 26, 7, 221/13, 82, 87, 88; 206/528, 531, 532, 538

(56) References Cited

U.S. PATENT DOCUMENTS

| | | | | |
|---|---|---|---|---|
| 3,888,350 A | | 6/1975 | Horvath | |
| 3,942,630 A | | 3/1976 | Phillips | |
| 3,993,190 A | | 11/1976 | Schmidgall | |
| 4,159,568 A | | 7/1979 | Berner | |
| 4,284,204 A | | 8/1981 | Carey, Jr. | |
| 4,485,915 A | | 12/1984 | Berghahn | |
| 4,561,544 A | | 12/1985 | Reeve | |
| 4,844,284 A | | 7/1989 | Drozd et al. | |
| 5,019,125 A | | 5/1991 | Rebne et al. | |
| 5,082,137 A | | 1/1992 | Weinstein | |
| 5,109,984 A | | 5/1992 | Romick | |
| 5,244,091 A | * | 9/1993 | Tannenbaum | 206/462 |
| 5,878,887 A | | 3/1999 | Parker et al. | |
| 6,036,018 A | | 3/2000 | Harrold | |
| 6,149,029 A | * | 11/2000 | de Meyer et al. | 221/25 |

* cited by examiner

*Primary Examiner*—Kenneth W. Noland
(74) *Attorney, Agent, or Firm*—Kenneth P. Glynn, Esq.

(57) ABSTRACT

A child resistant multiple dosage blister pack dispenser includes a main housing bottom component having walls and a bottom panel for supporting a blister pack, and a main top component. The bottom panel has a plurality of orifices located so as to position a blister pack thereabove, with individual dosages of the blister pack located above the orifices. These orifices are of sufficient size and shape to push individual dosages from the blister pack therethrough. The main housing top component is permanently connected to the bottom component and is laterally moveable relative to the bottom component. The top component has a first position, being a rest position, and having a second position, being a dispensing position. There is a biasing spring connected to at least one of the bottom component and the top component, that biases the top component relative to the bottom component so that the top component is in its first position. There are a plurality of push tabs located on the top component in an array corresponding to the plurality of orifices on the bottom component. These plurality of push tabs are not located above the orifices or the individual dosages when the top component is in its first position. Further, the plurality of push tabs are located above the individual dosages and the bottom component orifices for pushing dosage from the blister pack therethrough when the top component is in its second position.

20 Claims, 3 Drawing Sheets

1
3
5
7
8
11
12
13
14
15
16
17
18
19
20
21
23
24
25
26
33
35
51
53
54
63
70
72
103
109

CHILD RESISTANT MULTIPLE DOSAGE BLISTER PACK DISPENSER

BACKGROUND OF THE INVENTION

1. Field of the Invention

The present invention relates to a unique solution to protecting multiple dosage blister packs from children. The invention is a dispenser in which a multiple dosage blister pack is stored, whereby it is locked into the dispenser to isolate and encompass it, thereby disabling it from puncture or content (tablet or medication) removal. A user must first advance (shift) a top and bottom unit relative to one another, and then press a push tab to release a dosage. As soon as the user lets go of the shifted components, they move back to the secured, child resistant position.

2. Information Disclosure Statement

The following United States Patents are exemplary of the state of the art for blister packs and child resistant blister packs:

U.S. Pat. No. 3,888,350 describes a snap lock and squeeze open slide top container that has a small centered catch depending from the inner face of the cover. The edge of the catch forms with the closed end of the cover a slot which accommodates the rear edge of the drawer portion of the container. The profile of the catch is tapered, forming an inclined plane directed to the front end of the container. The cover and drawer are slidably engaged by lateral meshing flanges which are interrupted near the closed end to provide slight clearances between the inside of the cover and the outside of the drawer. These clearances, together with an inverted V-shaped cut centered in the rear skirt of the cover, permit the cover to bow up when the sides are squeezed, releasing the edge of the drawer portion from the slot formed by the catch, to open the drawer. When the drawer is closed, the edge portion rides forward along the inclined plane depending from the cover, engaging the slot with a click, to lock the container closed. To prevent spillage, the opening of the drawer is limited by a pair of small stops depending from the inner face of the cover near each side wall, which ride in elongated recesses in the lateral walls.

U.S. Pat. No. 3,942,630 describes a sliding cover safety package including a container having a cover mounted thereon for slidable movement between open and closed positions with respect to the container. The container and cover are provided with locking lugs having a locked position when the cover is closed in which the cover is locked against movement from its closed position with respect to the container, and an unlocked position when the cover is closed in which the cover can slide with respect to the container to its open position. The locking lugs are movable between the locked and unlocked positions by axial movement of the cover with respect to the container. Resilient biasing members is engaged between the container and cover to bias the locking lugs to the locked position such that the cover can slide from its closed position with respect to the container only after axial movement of the cover with respect to the container against the biasing members.

U.S. Pat. No. 3,993,190 describes a method and apparatus for packaging and dispensing stain removing agents in small, individual capsules. The stain removing agents are preferably in paste form. The individual capsules are readily deformable and are stored in individual troughs in a receiving plate which, in turn, is covered by a covering sheet.

U.S. Pat. No. 4,159,568 describes a container for capsules and the like having a cutter associated with the container for cutting the capsules. Hinged upper and lower portions of the container have cutting members secured thereto. Closure of the container portions effects cutting of a capsule inserted between the cutting members. In the preferred embodiments, the cutting members comprise a trough-shaped notch in the front wall of one of the container portions and a blade secured to the front wall of the other of the container portions, the blade and notch being superposed. An internal compartment is provided to receive a cut portion of a capsule.

U.S. Pat. No. 4,284,204 describes a two-part package that includes a sleeve for receiving a try. One surface of the sleeve has openings formed therein for receiving dimpled detents formed in the tray. As the tray is fully positioned in the sleeve, the detents engage the openings and retain the tray thereby inhibiting unwanted opening of the package and release of contents. Upon exertion of sufficient manual force on the sides of the sleeve, detent action is overcome and the package is opened as desired.

U.S. Pat. No. 4,485,915 describes a child resistant package having an outer container and an inner product supporting tray; the inner tray is adapted to be inserted into the container to a locked position and removed therefrom by disengaging a locking means and withdrawing the tray; the inner tray is disengaged from the container by pressing inwardly a pair of flexible tabs formed at the back end of the side walls of the tray; in a preferred embodiment a blister pack containing tablets is disposed on the product tray and the tray bottom is provided with holes through which the tablets in the blister pack may be pushed.

U.S. Pat. No. 4,561,544 describes a child resistant container for pills and the like that has a try which slidably engages a lid and is locked in a fully closed position as a spring arm on the tray urges a locking detent on the arm into engagement with a locking aperture located in an adjacent side wall of the lid. Manual depression of the detent releases the tray for opening as an exposed front wall thereof is pulled.

U.S. Pat. No. 4,844,284 describes a child resistant package that includes a tray with a compartment therein for receiving articles to be packaged, and a cover member slideably received on the tray and movable relative to the tray between opened and closed positions. The cover member is a flexible member having a top wall and peripheral side walls. The peripheral side walls of the cover member overlie peripheral side walls of the tray and latching members on the side walls of the cover member and tray cooperate to retain the cover member in a closed position relative to the tray. The latching members are released by applying an inward pressure to the top wall of the cover member to thereby bias the side walls of the cover member outwardly relative to the side walls of the tray. An abutment member on the tray prevents such inward deflection of the top wall of the cover member in the event that a child bites down on the package on the forward region thereof. Preferably, a peripheral skirt is provided on the tray for overlying lower marginal surfaces of the peripheral walls of the cover member, to thereby prevent a child from wedging his or her teeth between the peripheral walls of the cover member and tray, and thereafter prying the cover member off the tray.

U.S. Pat. No. 5,019,125 describes a solid medicament dispensing device having a cover and tray to provide a container for a cartridge for the solid medicament. The cover has hinged panel members and the tray an opening in the floor. When the hinged panel members are moved against the cartridge, it forces the medicament out of the cartridge and through the tray opening. The dispensing device is particularly suited for dispensing large dosages of capsules.

U.S. Pat. No. 5,082,137 describes a child resistant locking slide box that is opened by deforming a locking tab on the slide box drawer that positively engages the surrounding cover. There are tracks on the inside surfaces of the cover side walls that positively engage and slide along tracks positioned on the outside surfaces of the drawer side walls. The engagement of the cover and draw tracks allow only for the respective lateral movement of the cover across the drawer. The lateral movement of the cover allowed by the tracks is restricted in one direction by the drawer locking tab.

The drawer locking tab has a step that overlaps the cover surface. To open the slide box the cover tab must first be deformed backward, removing the step from the above cover, and then downward so that the whole locking tab is beneath the cover. Once the draw tab is below the cover, the drawer can be pushed past the cover, exposing the contents of the drawer.

U.S. Pat. No. 5,109,984 describes reusable, plastic medication dispensing containers for dispensing medication from a blister pack. The container includes a top, bottom, and retaining frame the are molded from a one-piece plastic and hingeably connected one to the other.

U.S. Pat. No. 5,878,887 describes a child-resistant blister package having a tray adapted to receive a blister card with at least one blister compartment is provided. The tray includes a first slide component. A cover having a top and a second slide component is provided. The second slide component is complementary to and slidingly engaged with the first slide component. The second slide component is connected to the top of the cover such that the cover can be slidably displaced relative to the tray between a first position, in which the top of the cover substantially overlies the tray and is adapted to prevent access to the blister card, and a second position, in which the cover is displaced at least partially from the tray such that the blister card is exposed. A tab is connected to the cover, and one of a locking projection and slot is located on the tab. The other of the slot and the locking projection is located on a first portion of the tray in a complementary location to the locking projection when the cover is in the first position, such that the locking projection is engaged in the slot to limit relative movement of the cover with respect to the tray. One of the tab and first portion of the tray is movable to a position in which the locking projection is disengaged from the slot to permit movement of the cover to the second position.

U.S. Pat. No. 6,036,018 describes a child resistant safety container for blister packs with a housing with an opening, and slides located inside the housing which position and retain several drawers inserted into the opening. A latching mechanism is provided to engage and retain each of the drawers when inserted into the housing. The latching mechanism has cooperating male and female parts located on the drawer and the housing in positions complimentary to each other. The part located on the housing is functionally operable with a latching trigger slidably connected to the housing. Resilient living springs are provided to urge each of the drawers into latching engagement and, when a drawer is pushed in against the spring, moves to partially disengage the drawer. The latching trigger moves the latching mechanism into a second position fully disengaging the drawer for removal. The remainder of the drawers which have not been pushed in remain retained in the safety container by the latching means.

Notwithstanding the prior art, the present invention is neither taught nor rendered obvious thereby.

SUMMARY OF THE INVENTION

The present invention is a child resistant multiple dosage blister pack dispenser that may be inexpensively produced, yet will function effectively and efficiently. The present invention dispenser includes a main housing bottom component having walls and a bottom panel for supporting a blister pack, and a main top component. The bottom panel of the bottom component has a plurality of orifices located so as to position a blister pack thereabove, with individual dosages of the blister pack located above the orifices. These orifices are of sufficient size and shape to push individual dosages from the blister pack therethrough.

The main housing top component is permanently connected to the bottom component and is laterally moveable relative to the bottom component, i.e., it may be pushed or moved back and forth relative to the bottom component. The top component has a first position, being a rest position, and having a second position, being a dispensing position.

There is also a biasing spring connected to at least one of the bottom component and the top component, that biases the top component relative to the bottom component so that the top component is in its first position. Thus, a user may shift the top component relative to the bottom component by pressing, pushing, pulling or otherwise moving one relative to the other to move the top component to its second position.

There are a plurality of push tabs located on the top component in an array corresponding to the plurality of orifices on the bottom component. These plurality of push tabs are not located above the orifices or the individual dosages when the top component is in its first position. Further, the plurality of push tabs are located above the individual dosages and the bottom component orifices for pushing dosage from the blister pack therethrough when the top component is in its second position.

The present invention dispenser main housing top component, in most preferred embodiments, has at least two side walls, a front and a back, and a top panel wherein the push tabs are located in the top panel. The top component and bottom component may be slideably connected to one another in any known manner. In one preferred embodiment, the dispenser bottom component includes one of a track and a track rider on its walls, and the top component includes walls having the other of the track and track rider on its walls. The track rider is located in the track so as that the track rider is slideable therein. In some preferred embodiments, there are two opposite tracks and two corresponding track riders along the walls.

The dispenser biasing spring may be located anywhere on the dispenser where it will function. In some embodiments, the biasing spring is unistructurally formed with at least one of the top component and the bottom component. The main housing top component should be similar in size, and have any shape desired. In some preferred embodiments, the dispenser main housing top component and bottom component are rectilinear. In some of these embodiments, the dispenser top component second position is located in a shifted position from sliding back to front.

In some embodiments, either the top component or the bottom component or both include an open area for insertion of a blister pack. In other embodiments, the blister pack is sealed inside the dispenser. In those embodiments wherein a blister pack is slid into the dispenser, one of the top component and the bottom component may include a blister pack retainer stop to prevent removal of a blister pack therefrom.

The top component, the bottom component and the biasing spring may be made of metal, plastic, cellulosic materials or combinations thereof, and may be formed or made separately. Plastic is preferred and two of these components may be formed or molded together. In some preferred embodiments, the main housing top component and the bottom component may be molded components formed as a unistructural (single) piece. These may be molded along with the spring wherein they are connected by the biasing spring, and are adapted to be folded and snapped together.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
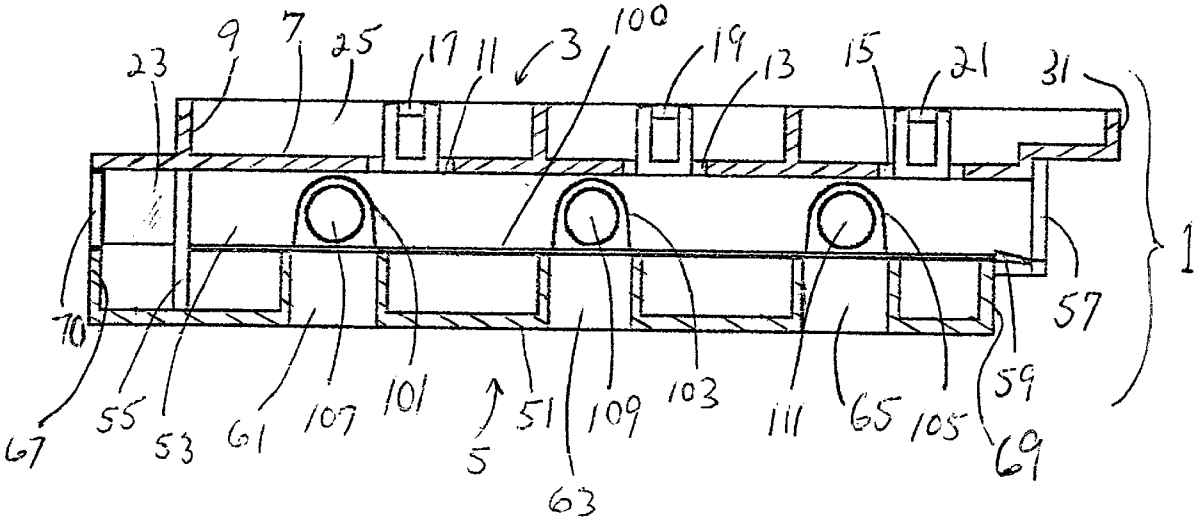
FIG. 1 shows a cut side view of one embodiment of the present invention child resistant multiple dosage blister pack dispenser.

FIG. 1 shows a side cut view of a preferred embodiment of present invention child resistant multiple dosage blister pack dispenser 1, which includes a top component 3 and a bottom component 5, which are the two primary components of the present invention device. Top component 3 includes a top panel 7, a front wall 9, a back wall 31, a side wall 25 (as well as side wall 26 discussed in conjunction with other Figures below). Bottom component 5 includes a bottom panel 51, a front wall 67, a side wall 53 and a back wall 69. Top panel 7 includes a plurality of orifices 11, 13 and 15, as well as push tabs 17, 19 and 21 located therein. These push tabs are extended and are connected so as to be spring-like and, hence, depressible, that is, they may be pushed downwardly into their respective orifices. FIG. 1 shows top component 3 at rest relative to bottom component 5. In other words, it is in its first position, being a rest position, so that the push tabs are not located above individual dosages. However, top component 3 is slidably connected to bottom component 5 and top component 3 may be pushed from back to front so as to align the push tabs to permit individual dosage dispensing.

Figure 3:
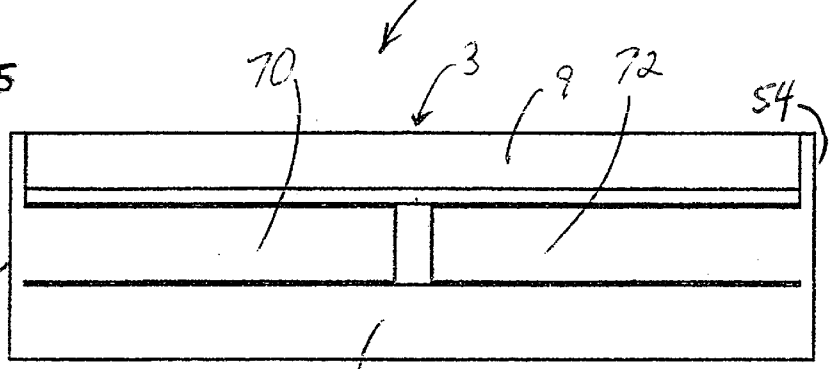
FIGS. 2 and 3 show a back end and front end view thereof, respectively.

Bottom component 5 includes a bottom panel 51, having a plurality of orifices, such as orifices 61, 63 and 65 and has a front wall 67 with springs 70 and 72 (as illustrated in FIG. 3 below). Top component 3 includes a spring push rod 23 against which spring 70 pushes to maintain top component 3 in its first position relative to bottom component 5. Bottom component 5 also includes back wall 69. Above back wall 69 is an opening 57 for insertion of a blister pack such as blister pack 100. Bottom component blister pack stop 55, in cooperation with ramp 59, causes an inserted blister pack 100 to rest with its dosage encapsulation 101, 103 and 105 containing their individual dosage 107, 109 and 111, respectively, to rest above orifices 61, 63 and 65 located in bottom panel 51. Ramp 59 also acts as a stop to prevent or inhibit removal of blister pack 100 from child resistant multiple dosage blister pack dispenser 1.

Figure 2:
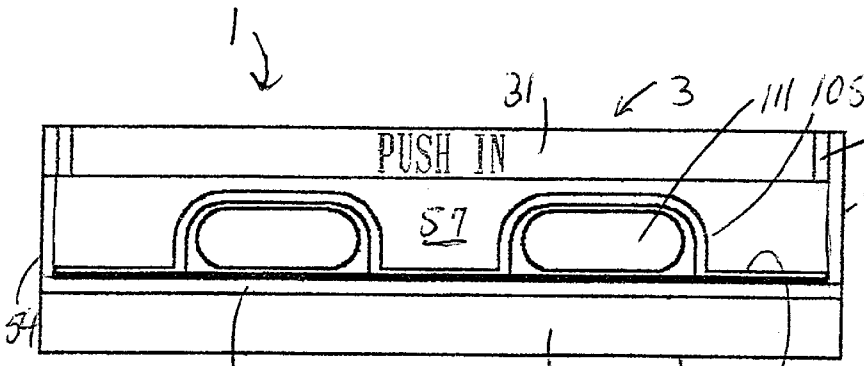

FIG. 2 shows a back end view and FIG. 3 shows a front end view of the present invention child resistant multiple dosage blister pack dispenser 1 described above. All of the Figures, that is FIGS. 1–6, show various views and positions of the same preferred present invention device and, thus, all identical elements are identically represented throughout the drawings and, hence, are not repeated with respect to every Figure.

Figure 4:
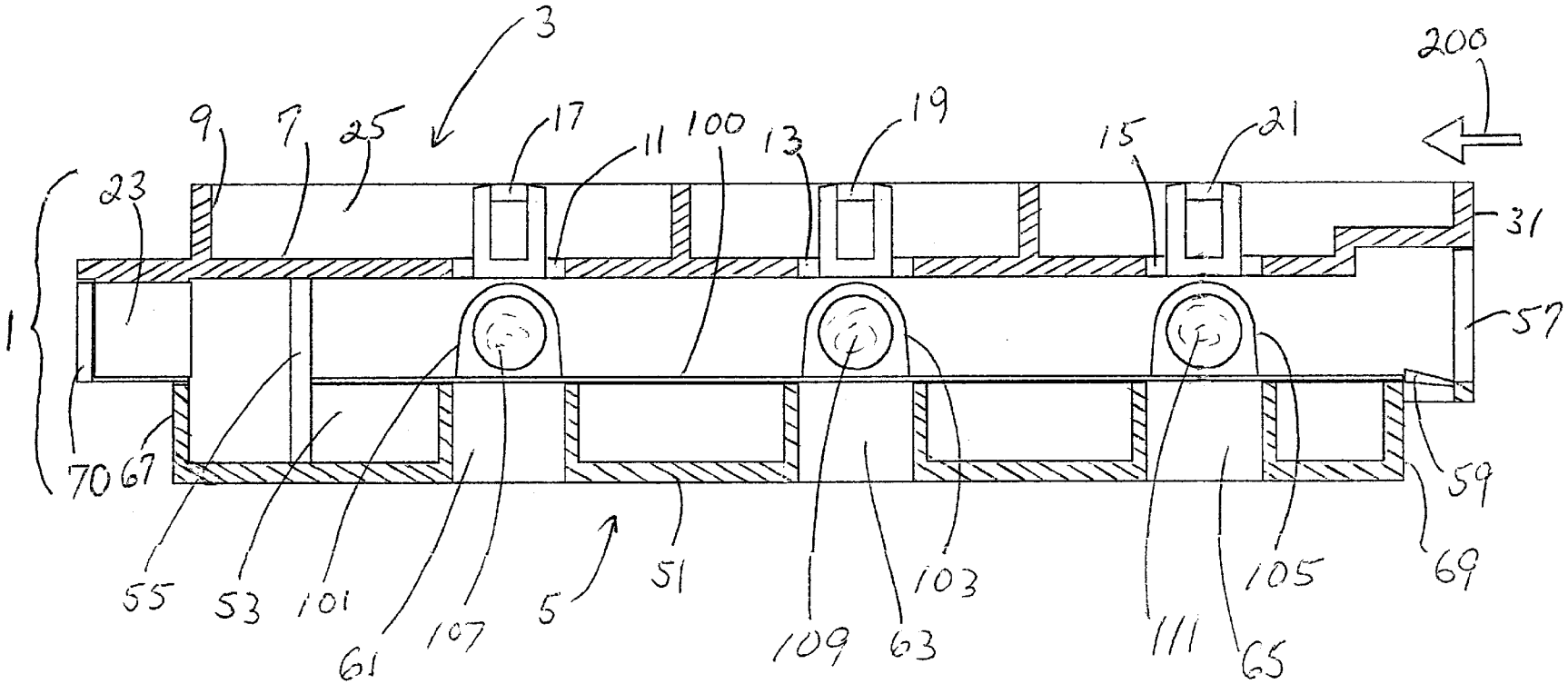
FIGS. 4 and 5 illustrate a side cut view and a top view, respectively, of the present invention dispenser shown in FIG. 1, but with the top component pushed from back to front, stressing a spring and positioning the top component over the bottom component for dispensing it; and, FIG. 6 shows a front, partially cut view of the present invention device shown in FIGS. 4 and 5, but with a medicine dosage being dispensed.

FIG. 2 more clearly shows the back end view of child resistant multiple dosage blister pack dispenser 1, wherein top component back wall 31 is labeled with instructions. In FIG. 3, the two springs 70 and 72 are shown in their rest position and are holding top component 3 in a non-dispensable mode relative to bottom component 5. If a user holds the device between the fingers and thumb, with fingers on bottom component front wall 67 and the thumb on top component back wall 31 and pushes, the shift in accordance with arrow 200 of FIG. 4 will result in top component 3 being in its second position. Referring to FIG. 4, top component 3 has its orifice aligned with the orifice of bottom component 5 and pushing on the push tabs such as push tab 17 or push tab 19 will release an individual dosage of medication from blister pack encapsulation.

Figures 5, 6:
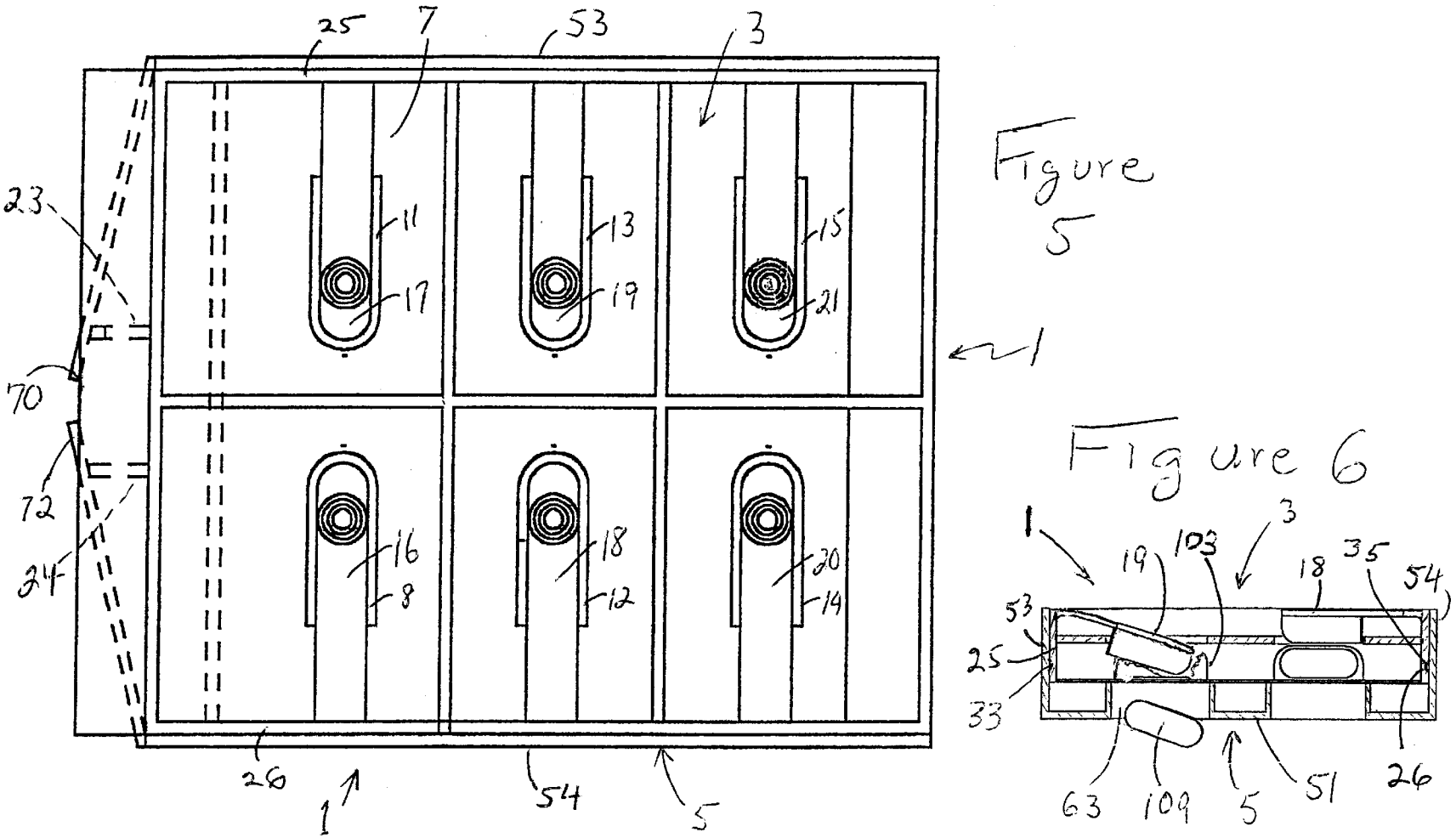

FIG. 5 shows a top view of child resistant multiple dosage blister pack dispenser 1 in its second position as shown in FIG. 4. Here, top panel 7 is illustrated showing all six orifices 11, 13 and 15, as well as 8, 12 and 14. Likewise, all push tabs are shown, including push tabs 16, 18 and 20. FIG. 5 also illustrates top component side walls 25 and 26 advance forward relative to bottom component side walls 53 and 54, with push rods 23 and 24 pushing against springs 70 and 72. (FIG. 6 shows bottom component side walls 53 and 54 with protrusions 33 and 35 respectively, fitting into a slot on the outside of side walls 25 and 26 of top component 3. As soon as a user releases top component 3 relative to bottom component 5, springs 70 and 72 automatically restore top component 3 to its first, rest position.

FIG. 6 shows a cut front end view of child resistant multiple dosage blister pack dispenser 1 with push tab 19 being depressed so as to release individual dosage 109 through orifice 63.

The present invention device may be made of plastic, metal, cellulosic products or a combination thereof. Further, opening 57 is used in embodiment wherein a blister pack may be inserted at some location or time after assemblage of the device itself. Alternatively, the device would have no insertion orifice to receive a blister pack, but would-be assembled with the blister pack being inserted before the top component and bottom component are assembled together. Also, it would be within the scope of the present invention to have the blister pack initially aligned with the top component tabs but not aligned with the bottom component orifice. This would be achieved by, for example, having the top component extend downwardly with a receiving cage for the blister pack and stops to properly align the individual dosages accordingly.

Obviously, numerous modifications and variations of the present invention are possible in light of the above teachings. It is therefore understood that within the scope of the appended claims, the invention may be practiced otherwise than as specifically described herein.

What is claimed is:

1. A child resistant multiple dosage blister pack dispenser, which comprises:

(a.) a main housing bottom component having walls and a bottom panel for supporting a blister pack, said bottom panel of said bottom component having a plurality of orifices located so as to position a blister pack thereabove, with individual dosages of said blister pack located above said orifices, said orifices being of sufficient size and shape to push individual dosages therethrough;

(b.) a main housing top component permanently connected to said bottom component and laterally moveable relative to said bottom component, said top component having a first position, being a rest position, and having a second position, being a dispensing position;

(c.) a biasing spring connected to at least one of said bottom component and said top component and biasing said top component relative to said bottom component to said top component first position, wherein a user may shift said top component relative to said bottom component by pressing one relative to the other to move said top component to said second position; and, (d.) a plurality of push tabs located on said top component in an array corresponding to said plurality of orifices of said bottom component, said plurality of push tabs being located not above said orifices when said top component is in said first position, and said plurality of push tabs being located above said orifices for pushing dosage from said blister pack therethrough when said top component is in said second position.

2. The dispenser of claim 1 wherein said bottom component includes one of a track and a track rider on its walls and said top component includes walls having the other of said track and a track rider on said walls, and said track rider is located in said track so as that said track rider is slideable therein.

3. The dispenser of claim 2 wherein there are two opposite tracks and two corresponding track riders.

4. The dispenser of claim 1 wherein said biasing spring is unistructurally formed with at least one of said top component and said bottom component.

5. The dispenser of claim 1 wherein said main housing top component has at least two side walls, a front and a back, and a top panel wherein said push tabs are located in said top panel.

6. The dispenser of claim 5 wherein said main housing top component and bottom component are rectilinear.

7. The dispenser of claim 6 wherein said top component second position is located in a shifted position from sliding back to front.

8. The dispenser of claim 1 wherein at least one of said top component and said bottom component includes an open area for insertion of a blister pack.

9. The dispenser of claim 8 wherein at least one of said top component and said bottom component includes a blister pack retainer stop to prevent removal of a blister pack therefrom.

10. The dispenser of claim 1 wherein said main housing top component and bottom component are molded components formed as a unistructural piece connected by said biasing spring, and are adapted to be folded and snapped together.

11. A child resistant multiple dosage blister pack dispenser, which comprises:

(a.) a main housing bottom component having walls and a bottom panel for supporting a blister pack, said bottom panel of said bottom component having a plurality of orifices located so as to position a blister pack thereabove, with individual dosages of said blister pack located above said orifices, said orifices being of sufficient size and shape to push individual dosages therethrough;

(b.) a main housing top component permanently connected to said bottom component and laterally moveable relative to said bottom component, said top component having a first position, being a rest position, and having a second position, being a dispensing position;

(c.) a biasing spring connected to at least one of said bottom component and said top component and biasing said top component relative to said bottom component to said top component first position, wherein a user may shift said top component relative to said bottom component by pressing one relative to the other to move said top component to said second position;

(d.) a plurality of push tabs located on said top component in an array corresponding to said plurality of orifices of said bottom component, said plurality of push tabs being located not above said orifices when said top component is in said first position, and said plurality of push tabs being located above said orifices for pushing dosage from said blister pack therethrough when said top component is in said second position; and, (e.) a blister pack located on said bottom component bottom panel and under said top component, said blister pack having a plurality of individual dosages positioned and arranged so as to correspond to and be located above said orifices of said bottom component.

12. The dispenser of claim 11 wherein said bottom component includes one of a track and a track rider on its walls and said top component includes walls having the other of said track and a track rider on said walls, and said track rider is located in said track so as that said track rider is slideable therein.

13. The dispenser of claim 12 wherein there are two opposite tracks and two corresponding track riders.

14. The dispenser of claim 11 wherein said biasing spring is unistructurally formed with at least one of said top component and said bottom component.

15. The dispenser of claim 11 wherein said main housing top component has at least two side walls, a front and a back, and a top panel wherein said push tabs are located in said top panel.

16. The dispenser of claim 15 wherein said main housing top component and bottom component are rectilinear.

17. The dispenser of claim 16 wherein said top component second position is located in a shifted position from sliding back to front.

18. The dispenser of claim 11 wherein at least one of said top component and said bottom component includes an open area for insertion of a blister pack.

19. The dispenser of claim 18 wherein at least one of said top component and said bottom component includes a blister pack retainer stop to prevent removal of a blister pack therefrom.

20. The dispenser of claim 11 wherein said main housing top component and bottom component are molded components formed as a unistructural piece connected by said biasing spring, and are adapted to be folded and snapped together.

* * * * *